US006418653B1

(12) United States Patent
Bowles

(10) Patent No.: US 6,418,653 B1
(45) Date of Patent: Jul. 16, 2002

(54) ROTARY ACTIVATED GUN LOCKING MECHANISM

(76) Inventor: Shaun K. Bowles, 2617 12th St. NW., Canton, OH (US) 44718

( * ) Notice: Subject to any disclaimer, the term of this patent is extended or adjusted under 35 U.S.C. 154(b) by 0 days.

(21) Appl. No.: 09/732,461

(22) Filed: Dec. 7, 2000

(51) Int. Cl.[7] ..... F41A 17/00
(52) U.S. Cl. ..... 42/66; 42/70.01; 42/70.11
(58) Field of Search ..... 42/66, 70.01, 70.11

(56) References Cited

U.S. PATENT DOCUMENTS

| | | | | |
|---|---|---|---|---|
| 3,462,869 | A | 8/1969 | Wallace | 42/70.11 |
| 4,048,741 | A | 9/1977 | Chiodo et al. | 42/70.11 |
| 4,509,281 | A | 4/1985 | Dreiling et al. | 42/70.11 |
| 4,972,618 | A | 11/1990 | Justice, Sr. et al. | 42/70.11 |
| 5,081,779 | A | 1/1992 | Pack | 42/70.11 |
| 5,561,935 | A | 10/1996 | McCarthy et al. | 42/70.07 |
| 5,581,927 | A | 12/1996 | Meller | 42/70.11 |
| 5,671,560 | A | 9/1997 | Meller | 42/70.11 |
| 5,732,498 | A | 3/1998 | Arreguin | 42/70.11 |
| 5,946,840 | A | 9/1999 | Mickel | 42/70.11 |

FOREIGN PATENT DOCUMENTS

| | | |
|---|---|---|
| AT | 9922 | * 11/1902 |

* cited by examiner

*Primary Examiner*—J. Woodrow Eldred
(74) *Attorney, Agent, or Firm*—John D. Gugliotta

(57) ABSTRACT

A rotary activated gun locking mechanism is provided for is a revolver type handgun with an integral pick-proof lock. The lock functions by restraining the bullet chamber cylinder. A cylindrical type lock, similar to that used on vending machines, is located on the rear of the gun, right above the trigger. The lock, when engaged, allows for a pin to be extended into the bullet chamber cylinder or special lock receiving cavity where it extends into a matching hole. With the cylinder thus immobilized, it is impossible for the gun to fire as there are no bullets in the line with the firing pin. When an authorized user inserts the key into the lock, the pin can quickly be retraced to allow the gun to operate.

2 Claims, 3 Drawing Sheets

ROTARY ACTIVATED GUN LOCKING MECHANISM

RELATED APPLICATIONS

The present invention was first described in Disclosure Document Number 456,978 filed on Jun. 1, 1999. There are no previously filed, nor currently any co-pending applications, anywhere in the world.

BACKGROUND OF THE INVENTION

1. Field of the Invention

The present invention relates generally to the area of gun safety devices and, more particularly, to a rotary activated gun locking mechanism for precautionary gun safety measures.

2. Description of the Related Art

Children and adults have been accidentally shot with a handgun. A proper locking mechanism could eliminate most of the tragedies. There are different methods of securing guns against unauthorized use, but they all have some disadvantages associated with them. If the gun is secured in a locked cabinet, it is not readily available for use in self defense. Trigger locks are often misplaced after being removed and lost. Finally, all methods that rely on keys to secure the locking means are subject to picking or unauthorized key copying. A search of the prior art did not disclose any patents that read directly on the claims of the instant invention; however, the following references were considered related:

A search of the prior art did not disclose any patents that read directly the claims of the instant invention; however, the following references were considered related.

The following patents describe a locking device released by a key for a firearm:

U.S. Pat. No. 5,732,498 issued in the name of Arreguin;

U.S. Pat. No. 5,671,560 issued in the name of Meller, and

U.S. Pat. No. 5,581,927 issued in the name of Meller.

The following patents describe a trigger locking device to prevent firing of the gun:

U.S. Pat. No. 5,561,935 issued in the name of McCarthy et al.; and

U.S. Pat. No. 4,509,281 issued in the name of Dreiling et al.

The following patents disclose a rotation-preventing lock assembly for a gun:

U.S. Pat. No. 5,081,779 issued in the name of Pack;

U.S. Pat. No. 4,048,741 issued in the name of Chiodo et al;

U.S. Pat. No. 3,462,869 issued in the name of Wallace; and finally,

And, U.S. Pat. No. 4,972,618 issued in the name of Justice, Sr. et al describes a set screw locking mechanism for a revolver.

Consequently, a need has been felt for a means by which revolvers can be secured so that they cannot be fired, yet can be quickly enabled by an authorized user in the event that the handgun is needed.

SUMMARY OF THE INVENTION

It is therefore an object of the present invention to provide an improved gun-lock mechanism that has a unique key to prevent the chamber-receiving cylinder from receiving a cartridge in its chamber.

It is a feature of the present invention to provide an improved gun-safety mechanism that is quick to lock and unlock by inserting a pin in the cylinder to prevent its rotation and loading another cartridge (bullet) into the firing position.

Briefly described according to one embodiment of the present invention, a rotary activated gun locking mechanism is provided for is a revolver type handgun with an integral pick-proof lock. The lock functions by restraining the bullet chamber cylinder. A cylindrical type lock, similar to that used on vending machines, is located on the rear of the gun, right above the trigger. The lock, when engaged, allows for a pin to be extended into the bullet chamber cylinder or special lock receiving cavity where it extends into a matching hole. With the cylinder thus immobilized, it is impossible for the gun to fire as there are no bullets in the line with the firing pin. When an authorized user inserts the key into the lock, the pin can quickly be retraced to allow the gun to operate.

Additionally, the cylindrical nature of the lock, along with an internal anti-tamper pin, prevents unauthorized individual from gaining access to the operation of the gun by prying on it with a screwdriver or similar object.

The use of the present invention allows one to ensure that revolver type handguns are secure from unauthorized or accidental use without the inefficiencies of conventional weapon locking means such as trigger locks and the like.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
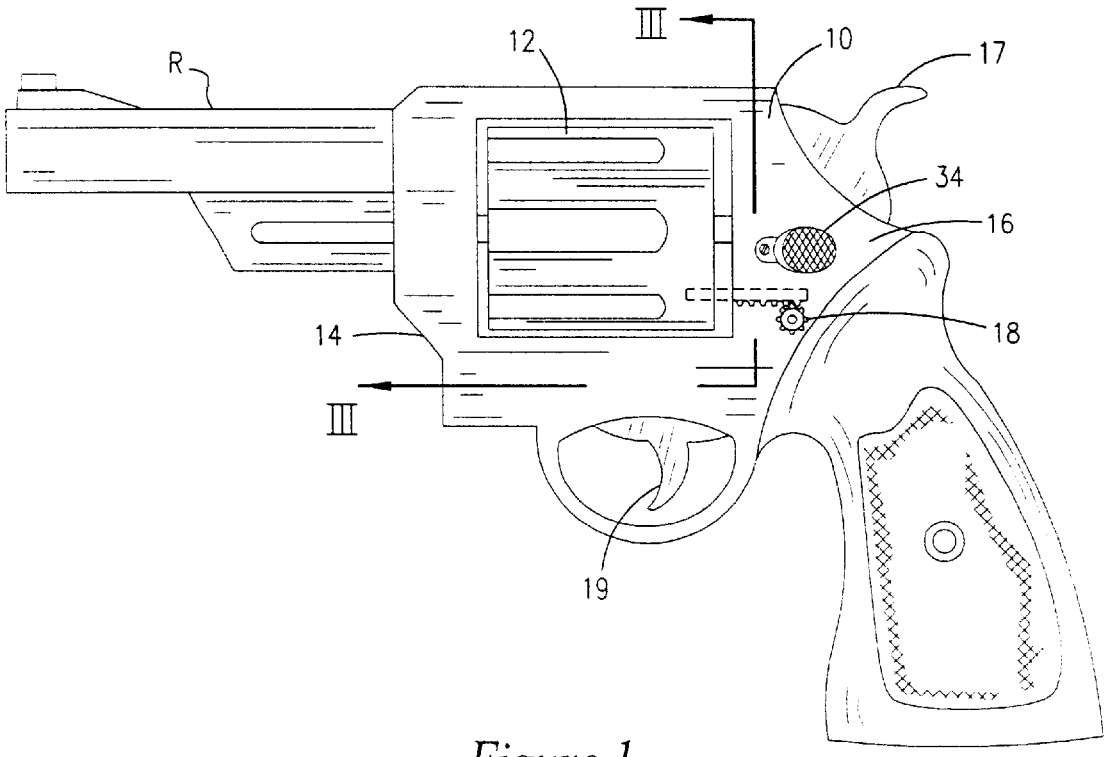
FIG. 1 is a side elevational view of a revolver incorporating a rotary actuated the present invention.
Figure 2:
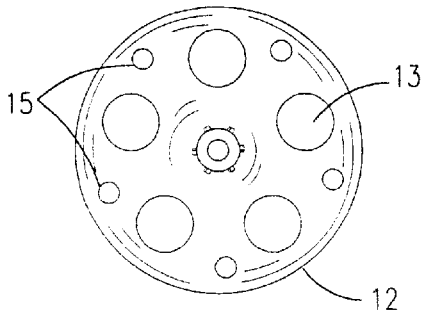
FIG. 2 is an exploded rear view of the cylinder 12 of the revolver.

Referring now to FIG. 1 and FIG. 2, a revolver R is generally shown incorporating a rotary activated gun mechanism. The present invention applies to all revolvers. But many of the details of a revolver are not shown for clarity in describing the present invention. The revolver R includes a frame 10, a supporting a cartridge-holding cylinder 12 rotatable about its axis 14, anterior and posterior sideplates 16, and a wheel-lock mechanism 18.

The cylinder 12 has a plurality of cylinder chambers 13 which are used to hold cartridges conventionally, as well as forming a wheel-lock receiving cavity 15. Although a plurality of equally spaced, radially aligned wheel-lock receiving cavities 15 are shown, allowing for engagement of the wheel lock 18 in any one of an equal number of cylinder positions. Any number of wheel-lock receiving cavities 15, or even one such cavity, can be used to practice the attributes of the present invention.

In conventional operation of the revolver R, a pivotable cartridge-striking hammer 17 is spring biased toward the frame 10 toward the cylinder 12 and manually pivotable to a first or cocked position against the spring biased away from the cylinder 12. The trigger 19 actuates the hammer into second (firing) position. Alignment of a loaded cylinder chamber 13 with the hammer 17 is therefore necessary for firing.

Figure 3:
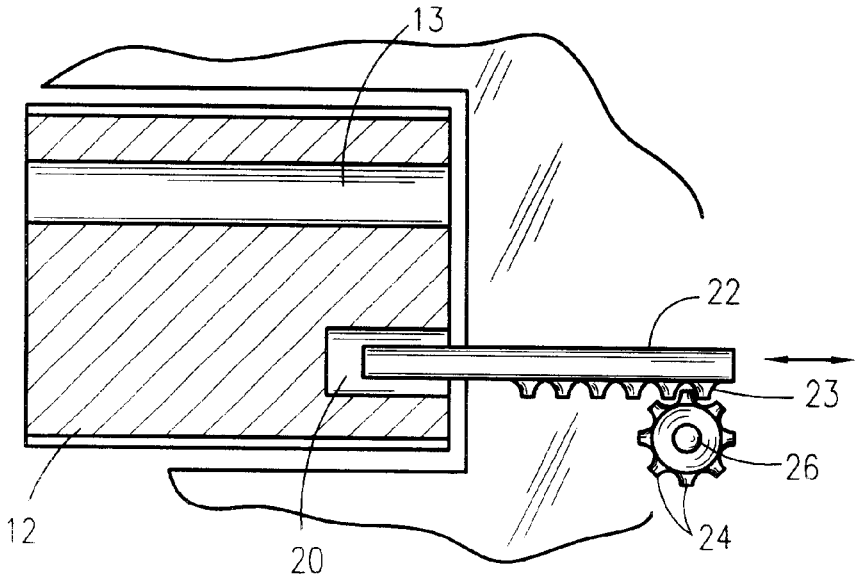
FIG. 3 is a partial cross-sectional of the view taken along line III—III of FIG. 1.
Figure 4:
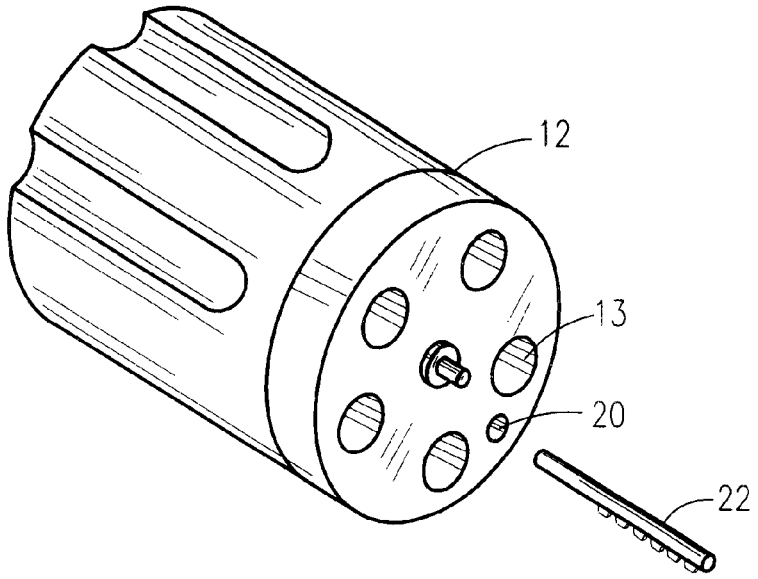
FIG. 4 is a partial exploded view of the spatial relationship of the cylinder 12 and the cylinder locking rod 23.
Figure 5:
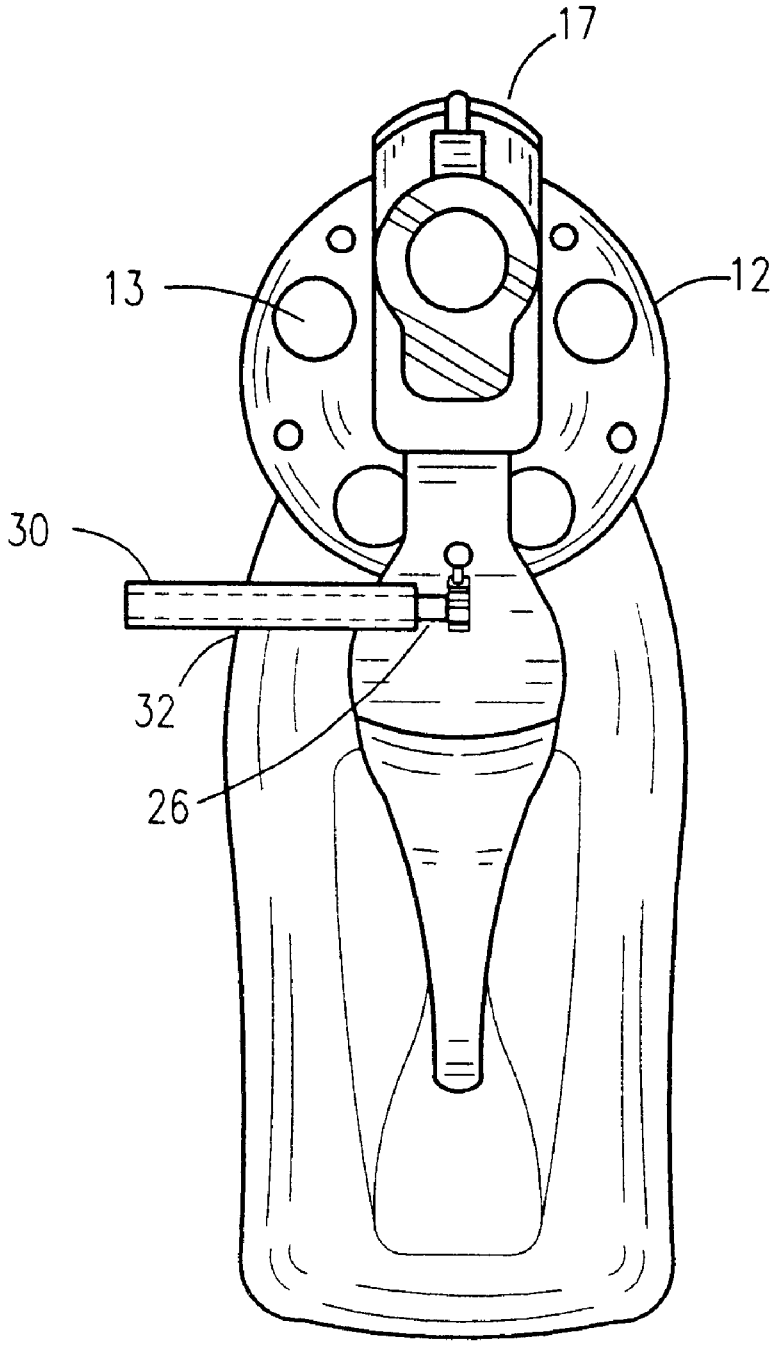
FIG. 5 is a rear elevational view of the revolver when the present invention is activated.

In conjunction with in FIG. 3 and FIG. 4, the cylinder 12 that forms the wheel-lock receiving cavity 15 receives a cylindrical locking rod 22. The inserted cylindrical rod 22 thereby detains the cylinder from rotating about its axis through this rigid mechanical impingement, disabling the trigger 19 from articulating the hammer 17 into its second position and prevents a cartridge from entering the chamber 13. Aligned along the lower length of the locking rod 22 are a series of spaced detente 23. As best shown in greater detail in FIG. 3, (but in conjunction with the other figures) the detente 22 engage with the gears defining an outer radial circumferential surface 24 and an actuating key bit 26.

2. Operation of the Preferred Embodiment

A key bit 26 of the actuating wheel-lock is positioned interior the anterior sideplate 16. It is anterior the pistol grip along the axis 14 of the revolver R and positioned posterior to the cylinder 12 along its axis 14 and below the thumbpiece. The keyhole 32 is designed to receive the hollow key shank 30 receivable over the key bit 26 and actuates the gears 24 to engage the detente 22. Rotating the key 30 clockwise engages the gears 24 with the detente 23 and linearly articulates the cylindrical locking rod 22 towards the cylinder into the wheel-lock receiving cavity. Rotating the key 30 counter-clockwise linearly articulates the cylindrical locking rod 22 towards the posterior of the revolver R.

The foregoing description is included to illustrate the operation of the preferred embodiment and is not meant to limit the scope of the invention. The scope of the invention is to be limited only by the following claims.

What is claimed is:

1. A gun locking mechanism for use with a revolver having a rotary activated gun mechanism, said revolver having includes a frame supporting cartridge-holding cylinder rotatable about its axis, anterior and posterior sideplates, said gun locking mechanism comprising:

a wheel-lock mechanism;

at least one wheel-lock receiving cavity formed between two adjacent said cylinders, a plurality of equally spaced, radially aligned wheel-lock receiving cavities formed between adjacent said cylinders provided for allowing for engagement of said wheel lock in any one of said receiving cavities, wherein said cylinder that forms the wheel-lock receiving cavity receives a cylindrical locking rod, said cylindrical locking rod inserted therein thereby detains the cylinder from rotating about its axis through this rigid mechanical impingement, wherein aligned along the lower length of the locking rod are a series of spaced detente. said detente engageable with gears defining an outer radial circumferential surface.

2. The gun locking mechanism of claim 1, further comprising an actuating key bit.

* * * * *